United States Patent [19]

Billon et al.

[11] 4,391,700

[45] Jul. 5, 1983

[54] PROCESS FOR CONVERTING HEAVY HYDROCARBON OILS, CONTAINING ASPHALTENES, TO LIGHTER FRACTIONS

[75] Inventors: Alain Billon, Orlienas; Jean-François Le Page, Rueil Malmaison; Jean-Pierre Peries, Mornant; Jean-Claude Simandoux, Ste. Foy Les Lyon, all of France

[73] Assignee: Institut Francais du Petrole, Rueil-Malmaison, France

[21] Appl. No.: 256,272

[22] Filed: Apr. 21, 1981

[30] Foreign Application Priority Data

Apr. 21, 1980 [FR] France ..... 80 08959
Apr. 21, 1980 [FR] France ..... 80 08960

[51] Int. Cl.[3] ..... C10G 47/22; C10G 21/14; C10G 45/08

[52] U.S. Cl. ..... 208/86; 208/97; 208/210; 208/211

[58] Field of Search ..... 208/86, 67, 68, 210, 208/48 R, 309

[56] References Cited

U.S. PATENT DOCUMENTS

| | | | |
|---|---|---|---|
| 2,952,613 | 9/1960 | Claridge | 208/86 |
| 3,193,487 | 7/1965 | Beuther et al. | 208/68 |
| 3,287,254 | 11/1966 | Paterson | 208/86 |
| 3,288,703 | 11/1966 | Spars et al. | 208/59 |
| 3,293,169 | 12/1966 | Kozlowski et al. | 208/59 |
| 3,321,395 | 5/1967 | Paterson | 208/67 |
| 3,334,043 | 8/1967 | Ferris et al. | 208/309 |
| 3,714,025 | 1/1973 | Aigenson et al. | 208/309 |
| 3,775,292 | 11/1973 | Watkins | 208/86 |
| 3,775,293 | 11/1973 | Watkins | 208/86 |
| 3,920,537 | 11/1975 | Walker | 208/48 R |
| 4,017,379 | 4/1977 | Iida et al. | 208/59 |
| 4,019,976 | 4/1977 | Cosyns et al. | 208/57 |

*Primary Examiner*—Delbert E. Gantz
*Assistant Examiner*—O. Chaudhuri
*Attorney, Agent, or Firm*—Millen & White

[57] ABSTRACT

Heavy asphaltenic oils are converted to lighter fractions by (a) Deasphalting the asphaltenic oil with an aliphatic $C_5$–$C_7$ hydrocarbon, (b) Maintaining the oil with hydrogen at 440°–530° C. and 40–140 bars in a non-catalytic conversion zone, and (c) Feeding the product of step (b) to a catalytic conversion zone at 320°–430° C. and 40–140 bars, the catalyst in said zone comprising at least one molybdenum and/or tungsten compound and at least one nickel and/or cobalt compound.

16 Claims, 1 Drawing Figure

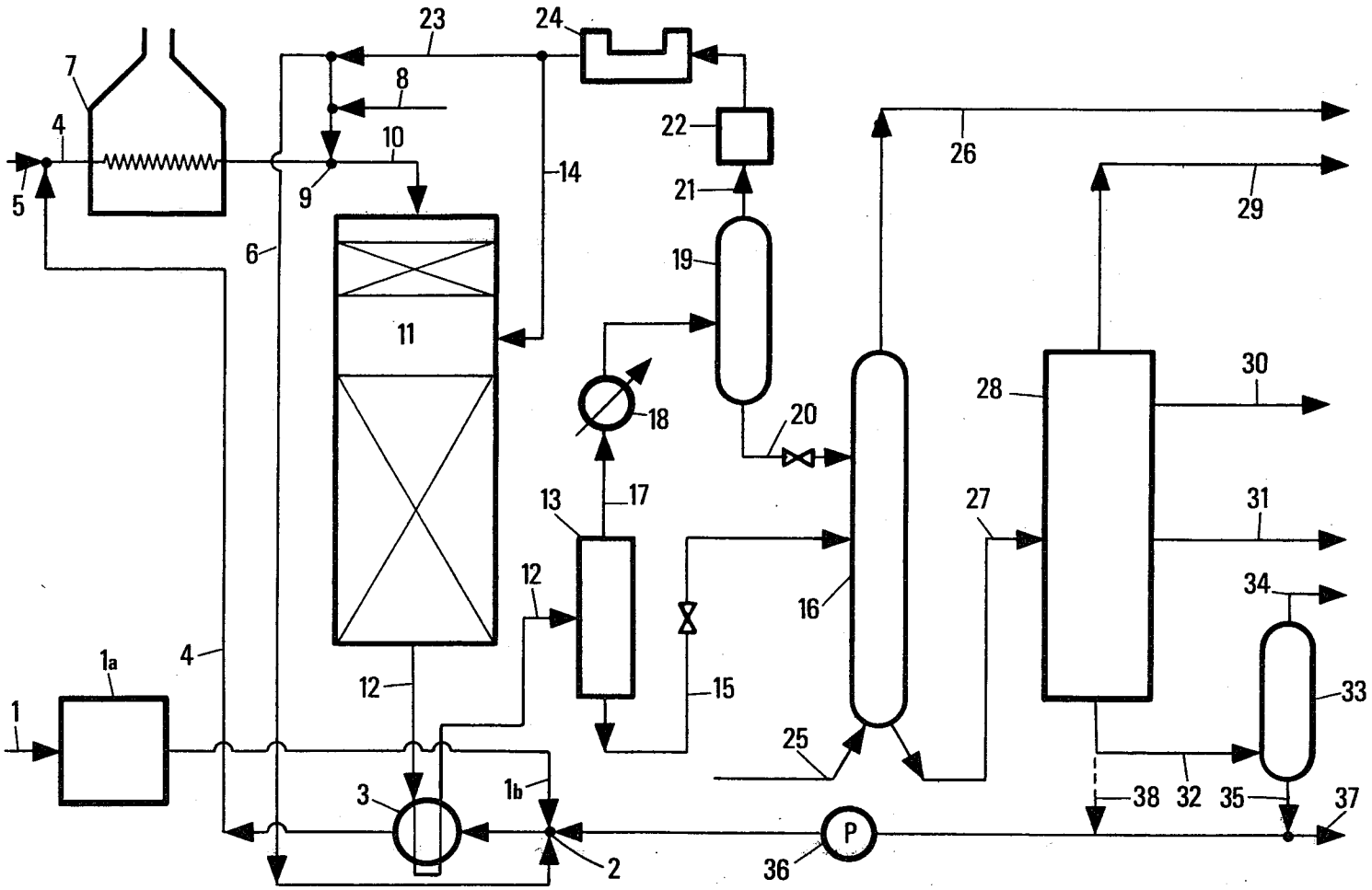
1
1a
1b
2
3
4
5
6
7
8
9
10
11
12
13
14
15
16
17
18
19
20
21
22
23
24
25
26
27
28
29
30
31
32
33
34
35
36
37
38
P

PROCESS FOR CONVERTING HEAVY HYDROCARBON OILS, CONTAINING ASPHALTENES, TO LIGHTER FRACTIONS

This invention relates to a process for hydroconverting deasphalted oils to lighter fractions and comprises a thermal hydrovisbreaking step and a catalytic hydrostabilization step for the resultant cracked products. More precisely, this process has been conceived to be coupled with a deasphaltingprocess wherein the solvent is a hydrocarbon or a mixture of hydrocarbons having, at least in major part, from 5 to 7 carbon atoms.

The deasphalted oils, whose treatment is an object of the invention, may be obtained by deasphalting vacuum residues or atmospheric residues from conventional crude oils whose specific gravity is lower than 0.950. These deashalted oils may also be obtained from heavy oils of specific gravity higher than 0.950, such as BOSCAN crude or a heavy oil from the ORENOQUE Belt in VENEZUELA or from ATHABASCA in CANADA; in the latter case, the feedstock subjected to preliminary deasphalting may be a vacuum residue or an atmospheric distillation residue, or a topped crude or a desalted crude. As a rule, the hydrocarbon feedstocks treated according to the invention consist of deasphalted oils obtained by deasphalting hydrocarbon feedstocks of any kind, containing asphaltenes or resins, such as oils obtained by liquefaction of coal or pyrolysis of bituminous shales. These feedstocks usually contain at least 80% by weight of constituents having a normal boiling point above 360° C. Their asphaltene content, determined with heptane, is conventionally higher than 0.5% by weight. Attention is however, called to the fact that the deasphalting operation which supplies the feedstocks to be treated according to the invention employs as solvent a hydrocarbon or a mixture of hydrocarbons having from 5 to 7 carbon atoms, so that the major part of the resins remains in the feedstock while efficient precipitation of the asphaltenes is obtained.

Within the domain of the present technique, two main refining processes have been proposed for converting deasphalted oils to distillates; the first process is based on catalytic cracking and the second on catalytic hydrocracking; in both cases, the deasphalted oil is previously hydrorefined to remove certain impurities such as sulfur, nitrogen and, above all, metals (nickel and vanadium) and to decrease the content of carbonizable components by partial hydrogenation of the pericondensed aromatic compounds. Catalytic cracking yields gasolines of good research octane number but gas oil of low cetane number which is commonly used as heating oil component; hydrocracking yieds middle distillates, jet fuels and diesel fuels of good quality but the resultant naphtha must be treated by catalytic reforming to meet with the octane requirements of the present gasolines. When compared with these two commonly used refining processes, the treatment of the present invention constitutes a third way to convert a deasphalted oil to naphtha, kerosene, gas oil and vacuum gas oil which can be used to produce heating oil of low sulfur content or which constitutes an excellent feedstock for catalytic cracking when the gasoline production must be increased.

OBJECT OF THE INVENTION

The invention relates to a process for hydroconverting oils previously deasphalted, by making use of a hydrocarbon having from 5 to 7 carbon atoms, to lighter fractions, comprising easily more than 50% by weight of fractions distilling below 520° C.

The process comprises three steps: a first step of deasphalting with a hydrocarbon having from 5 to 7 carbon atoms, a second visbreaking step carried out under hydrogen pressure at high temperature for 1 sec to 10 hours, preferably 1 to 500 sec, particularly 5 to 60 sec; and a third step of catalytic hydrostabilization. In the latter step, the cracking products, diolefins, olefins, aromatics, resins as well as asphaltenes formed in the thermal step hydrogenate completely or partially. The gases can then be separated and the liquids distilled. According to a preferred embodiment, a least one portion of the distillation residue is recycled to the hydrovisbreaking step. Other recyclings of liquid or gas fractions can also be performed according to the directions given hereunder, particularly as shown in the figure.

According to a particular characteristic of the invention, the feedstock is an oil which has been deasphalted with a hydrocarbon or a mixture of hydrocarbons having from 5 to 7 carbon atoms.

In these conditions, the conversion takes place in the hydrovisbreaking zone essentially at temperatures from 440° to 530° C.

According to a preferred embodiment of the invention the mixture when discharged from the cracking furnace, is cooled by mere quenching with hydrogen gas directly fed to the catalytic hydrorefining reactor. Quenching with hydrogen is intended to mean the mere addition of hydrogen at a temperature lower than the temperature of the product from the visbreaking step, so as to quickly or nearly instantaneously bring the temperature of this product to a value between 320° and 430° C., preferably between 350° and 410° C.

According to a preferred embodiment of the invention, the catalytic hydrorefining is conducted with two types of different catalysts arranged in two (or more) separate beds or reactors. This arrangement of the catalyst avoids the polymerization or polycondensation of the instable components unavoidably produced in the high temperature thermal cracking step.

According to another preferred embodiment of the process, at least one portion, for example at least 50% of the unconverted fraction is completely or partially recycled to the inlet of the thermal conversion zone from the bottom of the vacuum distillation column placed behind the hydrostabilisation unit or, according to another embodiment, from the bottom of the atmospheric distillation column placed at the same point, when a maximum production of naphtha, jet fuel and motor gas oil is desired. This recycled portion comprises at least 80% of constituents normally boiling above 360° C.

According to another embodiment of the invention, the thermal hydrocracking step and the hydrorefining step are conducted in the presence of steam, thereby reducing the rate of fouling both for the cracking furnace and the hydrorefining catalysts.

DESCRIPTION OF THE PRIOR ART

Several patents mention the association of a thermal treatment under pressure with a subsequent catalytic hydrotreatment. The U.S. Pat. Nos. 2,717,285; 3,132,088; 3,148,135; 3,271,302; 3,691,058; 3,806,444; 4,005,006 and 4,017,379 propose the association of a thermal treatment with a catalytic treatment either of the hydrorefining type or of the hydrocracking type.

Nevertheless none of these patents discloses the treatment of a deasphalted residue, particularly a residue which has been deasphalted under specific conditions.

The U.S. Pat. Nos. 3,089,843 and 3,148,135 propose the association of a thermal hydroconversion with a catalytic hydroconversion. The feedstock is normally a distillation residue, although a deasphalted residue may theoretically be used according to the first of these two patents; no precision is given on the nature of the deasphalting solvent.

The U.S. Pat. No. 3,288,703 proposes to associate a thermal hydrocracking with a catalyst hydrocracking effected on a previously deasphalted feedstock. In the working example, the contact time in the thermal hydrocracking zone is about 4 hours and only propane is used as deasphalting solvent.

The U.S. Pat. No. 3,293,169 also proposes the association of a thermal hydrocracking with a catalytic hydrocracking effected on a deasphalted feedstock. In the working example, the deasphalting solvent is a propane-butane mixture and the reaction time in the thermal hydrocracking zone is from 30 minutes to 5 hours.

None of the above patents has foreseen the advantage resulting from deasphalting with a hydrocarbon having from 5 to 7 carbon atoms; the use of this hydrocarbon makes it now possible to operate with considerably reduced contact times in the thermal zone, for example, 5 to 300 seconds. None of the above patents has foreseen the advantage resulting from recycling to the thermal step the residue obtained at the end of the catalytic hydroconversion step. No mention is made of quenching the effluent from the thermal reaction zone with hydrogen gas.

DETAILED DESCRIPTION OF THE INVENTION

FIG. 1 gives, by way of example, a simplified description of the arrangement of steps proposed in the invention. The feed charge is introduced into the unit through duct 1; it is conventionally deasphalted with one or more $C_5$ to $C_7$ hydrocarbons in the deasphalter referred to as 1*a;* the oil fraction, freed of asphalt and of extraction solvent, is conveyed through line 1*b* and admixed at point 2 with the unconverted heavy fraction and with a portion of the hydrogen gas recycled through duct 6. The resultant mixture is passed through exchanger 3 before being supplied through duct 4 to the thermal hydrovisbreaking furnace 7. The feed supplied to this furnace (content of asphaltenes precipitable with heptane preferably lower than 0.1% by weight) is essentially an oil which has been deasphalted with a hydrocarbon or a mixture of hydrocarbons having from 5 to 7 carbon atoms, as obtained by deasphalting vacuum residues, atmospheric residues, topped heavy crude oils or any heavy oil containing compounds of the resinic or asphaltenic type as, for example, certain shale oils or certain hydrogenizates obtained by coal liquefaction. The choice of the solvent used for deasphalting is important since it has surprisingly been found that under given severity conditions feedstocks with resinic components give a higher yield of lighter products than feedstocks the resinic compounds of which have been extracted by deasphalting with a light solvent such as propane, butanes or a mixture of these paraffinic hydrocarbons and their olefinic equivalents. This observation led to the selection as deasphalting solvent, of a hydrocarbon or a mixture of hydrocarbons having from 5 to 7 carbon atoms. It must be noted that the conversions obtained are for too high to be attributable to the sole resinic compounds yet present in the feed charge; it seems that these compounds behave as initiators of thermal reactions to which all the molecules of the treated charge take part. When these compounds are absent, for example, when treating a vacuum gas oil, thermal hydrocracking requires temperatures 30° to 60° C. above those applied in the treatment of atmospheric residues deasphalted with $C_5$ to $C_7$ hydrocarbons, or longer contact times.

Convenient $C_5$ to $C_7$ hydrocarbons, are, for example, n-pentane, isopentane, a saturated $C_7$ cut, a saturated $C_5$–$C_7$ cut or a $C_5$ or $C_6$ olefinic cut.

The deasphalting operation is usually conducted at about 150°–260° C. After this operation, the content of asphaltenes precipitable with heptane is advantageously lower than 0.1% by weight.

The thermal hydrovisbreaking operation is usefully conducted in one or more tubes plated in a furnace; the temperature of the reaction mixture (hydrocarbons+-hydrogen) is maintained, at least in the second half of the tubes where the cracking takes place, between 440° and 530° C. and preferably between 460° and 510° C. The pressure applied is from 40 to 140 bars and preferably from 70 to 110 bars; the residence time of the liquid feed charge is from 1 to 500 seconds and preferably from 5 to 60 seconds. The hydrogen gas may contain light hydrocarbons having from 1 to 4 carbon atoms, as well as low amounts of hydrogen sulfide and ammonia from the recycled hydrogen gas. It is however desirable that the hydrogen content of the recycle gas, at the inlet of the cracking furnace, be higher than 50% by volume and preferably higher than 70% by volume. The amount of hydrogen gas injected at the inlet of the oven is advantageously between 100 and 5000 $m^3$ per $m^3$ of charge and preferably between 300 and 1000 $m^3$ per $m^3$ of charge.

The products withdrawn from the thermal cracking furnace are cooled at point 9 by hydrogen injection, for example an in-line injection of a portion of the recycle gas previously admixed at point 8 with additional hydrogen compensating for the hydrogen consumption in the unit. It is advantageous that this additional hydrogen be introduced between the thermal hydrocracking stage (hydrovisbreaking) and the catalytic hydrogenation stage so as to produce, at the level of the hydrogenation catalyst, a hydrogen partial pressure avoiding polymerization of the olefins withdrawn from the thermal cracking stage and to displace to a maximum in favor of the production of naphthenes and naphthenoaromatics the thermodynamic equilibrium which controls the hydrogenation of the aromatic molecules, particularly the pericondensed aromatic molecules.

The mixture is supplied through duct 10 into the hydrogenation reactor 11. A conventional hydrodesulfurization catalyst comprising molybdenum and/or tungsten with a metal of group VIII such as nickel and/or cobalt can be used. However substantially improved results, as concerns the stability of the products, are obtained when using two distinct types of catalysts.

Irrespective of the type of catalyst initially employed, it has been found that it operates mainly in the sulfided state.

This sulfided state can be obtained, in a known manner, by prior sulfiding of the catalyst or can result from the presence of sulfur compounds in the feed charge.

When operating in the preferred manner with distinct catalyst beds, the first bed(s) comprises preferably a catalyst (A) based on VI A metal compounds promoted with cobalt and/or nickel compounds. The polymerization and polycondensation of the unstable components are largely avoided when the atomic ratio $$R = \frac{\text{Ni and/or Co}}{\text{W and/or Mo}}$$

is selected between 0.8 and 3, preferably between 1 and 2. The carrier is preferably a substantially neutral carrier having a neutralization heat by ammonia adsorption at 320° C. lower than 10 cal per gram under an ammonia pressure of 300 mm mercury. The active metals are incorporated in a conventional manner.

Among the carriers which satisfy this condition particularly well adapted aluminas are those having areas between 40 and 120 $m^2/g$ and which have been subjected to autoclaving under steam pressure, as well as cobalt, nickel, magnesium, calcium and/or barium aluminates. As a rule, the catalysts disclosed in the U.S. Pat. No. 4,019,976 can be used to constitute the first catalyst bed; nevertheless, within the precise domain of the process of the invention, the active agent content, expressed as the $MoO_3$, $WO_3$, NiO, CoO content by weight, is usefully selected between 6 and 30%, and preferably between 14 and 24%.

The preferred catalysts comprise the following associations: NiW, NiMo and CoMo; NiMo is preferably used in the process which is the object of the present invention.

In the ultimate(s) bed(s) of catalyst, the preferred catalyst is designed as (B). The previously defined ratio R is advantageously selected between 0.2 and 0.5, preferably between 0.25 and 0.35; preferred catalysts are those containing the associations NiW, NiMo, CoMo, but the association NiMo is preferred in the process of the present invention. A carrier of high specific surface is advantageously used, for example of the $\gamma$-alumina type ex boehmite or $\eta$-alumina type ex bayerite, or of the silica-alumina type with 1–10% b.w of silica, or again of the alumina-magnesia or silica-magnesia type containing 5–10% b.w. of magnesia and 95–90% b.w. of alumina or silica respectively. The acidity of the carriers, determined as above, is usefully higher than 30 cal. per gram; the area of the carrier is preferably between 150 and 350 $m^2/g$. Its pore volume is advantageously between 0.7 and 1 cc/g so that the pore diameter is higher than 100 A for more than 90% of the pore volume. In a known manner, the carrier is impregnated or agglomerated with precursor salts of the active agents, which, during the operation, are molybdenum or tungsten sulfides promoted with nickel or cobalt sulfides. The content by weight of the active agents, expressed as oxides, is advantageously selected between 6 and 30%, preferably between 14 and 24%.

The pressure in the catalytic hydrogenation unit is preferably selected between 40 and 140 bars. It is advantageously the same as in the thermal hydrocracking furnace. The space velocity is between 0.2 and 3 and preferably between 0.4 and 1.5. The temperature is between 320° and 430° C., preferably between 350° and 400° C. The amount of hydrogen gas is from 100 to 5,000, preferably 300 to 1000 m3/m3 of hydrocarbon feed charge. The ratio of the respective amounts of catalysts A and B charged in the reactor(s) is usefully between 0.1:1 and 1:1 and preferably between 0.3:1 and 0,7:1. Taking into account the exothermicity of the conversion, it is useful to quench the reaction products with hydrogen introduced through duct 14 into the reactor.

The products which have been stabilized by hydrogenation are withdrawn from reactor 11 through duct 12; they are passed through the exchanger 3 and supplied to the hot separator 13 where are separated a mixture of hydrogen gas with gasoline in gaseous state and heavier liquid effluents which are fed through duct 15 to the stripping column 16. The gas fraction is withdrawn from the separator 13 through duct 17 to be cooled in exchanger 18 before supply to the cold separator 19. The liquid fraction from separator 19 is expanded and injected at the top of the stripping column 16 through duct 20. Hydrogen gas from separator 19 is brought through duct 21 to a washing unit 22 for example for washing with amines, for extracting all or part of hydrogen sulfide; the gas is then recycled to the unit through duct 23 after having been compressed in unit 24. Steam (25) is introduced at the bottom of column 16 to separate a top light fraction containing hydrogen sulfide (line 26) while the heavy fraction, freed of hydrogen sulfide, is introduced through duct 27 into an atmospheric distillation column 28 where are separated, for example, a gasoline cut (29), jet fuel (30) and atomspheric gas oil (31). The heavy fraction withdrawn from the bottom of the column through duct 32 is supplied to a vacuum distillation column (33); vacuum gas oil (34) which constitutes an excellent feed charge for catalytic cracking or catalytic hydrocracking is withdrawn from the top of the column; the heavy fraction withdrawn through duct 35 from the bottom of the vacuum distillation column is preferably recycled, in whole or in part (for example, 10 to 100%), through pump 36 to the inlet of the thermal cracking stage, after having been admixed at point 2 with fresh charge and a portion of the recycle hydrogen. When operating with deasphalted oils of high resin content, a fraction of the heavy products can be discharged through duct 37.

According to a modified embodiment, the production of middle distillates can be increased by omitting the vacuum distillation column and recycling in whole or in part (for example 10 to 100%) the unconverted fraction withdrawn from the bottom of the atmospheric distillation column (line 38), whose initial boiling point is about 350° C.

Recycling of the heavy fraction withdrawn from the bottom of the atmospheric distillation column or from the bottom of the vacuum distillation column constitutes one of the particular embodiments of the invention. It has effectively been found that, when operating in conformity with the invention, i.e. by combining a thermal hydroconversion step with a step of catalytic hydrorefining at a low conversion rate, it is possible, while maintaining an acceptable cycle time for the catalyst, to recycle all or part of the heavy fraction; the small asphaltene fraction (0.2 to 6%) produced in the thermal step by polycondensation of the resins from the charge is converted at least to a large extent in the hydrogenation step according to the invention.

When the resin content of the charge is very high, for example 30% or more, it is advantageous to inject water at the inlet of the thermal hydrocracking furnace, in a small amount of 0.2–10%, preferably 1–5% of the total liquid hydrocarbon charge fed to the furnace; this water is injected as steam at point 5; it traverses the two thermal and catalytic units and is collected at the top of stripping column 26. This addition of steam delays the coking of the furnace and the fouling of the catalysts.

This water injection is particularly useful when the resin content of the feed charge is high, for example at least 30% by weight. The resin content can be determined by precipitation with propane, effected on a residue previously deasphalted with heptane.

EXAMPLES

Experiments have been conducted in a pilot plant conforming substantially with the flowsheet of the invention up to the stripping column inclusively. The operations of atmospheric and vacuum distillation were however conducted separately and the effect of recycling a heavy fraction was determined by admixing all or part of an unconverted heavy fraction with fresh charge in the charge drum. The catalytic reactor was operated with two isothermal catalyst beds which did not necessitate quenching with hydrogen between the two beds. Moreover washing with amines, which is preferred in the invention, was replaced with water-ammonia washing.

In these experiments, the asphaltene content has been determined by precipitation with heptane (British standard B.S. 4696:1971-I P 143/78).

EXAMPLE 1

The feed charge to be treated in a vacuum residue of a light ARABIAN oil whose characteristics are given in TABLE I.

It is first subjected to pentane deasphalting with a pentane/charge ratio of 5/1 by volume. The yield of deasphalted oil is 85% by weight.

After this deasphalting, the oil has the following characteristics:specific gravity: 0.977 g/cm$^3$.
CONRADSON carbon (% by weight): 9.0.
Asphaltenes (heptane insoluble)<0.05% b.w.
Viscosity at 100° C.: 120 cst.
Ni: 2.5 ppm b.w.
V: 14 ppm b.w.
% b.w. boiling above 520° C.: 5.

This deasphalted oil was used as feed charge in three distinct experiments:

EXPERIMENT NO. 1

Hydrovisbreaking alone

A mixture of deasphalted oil with hydrogen was passed through a furnace at 495° C. under a pressure of 100 bars, with a residence time of 10 seconds and a volumic ratio hydrogen/oil of 500 liters/liter. The effluent was abruptly cooled to about 400° C. by injection of cold hydrogen. The products were distilled and analyzed.

EXPERIMENT NO. 2

Hydrovisbreaking followed with hydrostabilization

The deasphalted oil was first subjected to the same hydrovisbreaking treatment as in experiment No. 1, up to and including—hydrogen quenching. The product was then directly passed with hydrogen through a catalytic reactor at 400° C., 100 bars, a feed rate (VVH) of 0.5 vol/vol of catalyst/hour and a $H_2$/hydrocarbons ratio of 700 liters/liter.

The catalyst was arranged as two successive beds:

| | First bed | Second bed |
|---|---|---|
| % by weight | 30 | 70 |
| Carrier area m$^2$/g | 102 | 210 |

-continued

| | First bed | Second bed |
|---|---|---|
| % NiO + $MoO_3$ (Weight) | 17 | 14 |
| $R = \frac{Ni}{Mo}$ (at) | 1 | 0.3 |

At the end of the operation, the products were distilled and analyzed.

EXPERIMENT NO. 3

Hydrovisbreaking followed with hydrostabilization and partial recycling to the inlet of the visbreaking unit of the 520° C.+ fraction obtained after hydrostabilization (the ratio by volume of the recycled fraction to the fraction 520° C.+ was 0.5).

The operating conditions of the hydrovisbreaking step and the hydrostabilization step were the same as in experiment No. 2.

The results are given in TABLE II. They show that the major part of the conversion takes place in the thermal step, although being very short, that the second step improves the yield and quality of the resultant products and finally that the yield is further increased by recycling.

EXAMPLE 2

This example was conducted with the 350° C.+ atmospheric residue of a light ARABIAN crude oil whose composition is given in TABLE III (column A). The vacuum gas oil was distilled and the vacuum residue deasphalted with pentane, as in example 1; the vacuum gas oil and the deasphalted residue were finally remixed. The resulting mixture (yield: 93.4% b.w. with respect to the atmospheric residue) had the composition given in TABLE III (column B).

The resultant mixture was treated by hydrovisbreaking followed with hydrostabilization in the conditions of experiment No. 2 of example 1, except that the hydrostabilization temperature was 380° C., instead of 400° C. The results are given in TABLE IV.

EXAMPLE 3

An atmospheric BOSCAN residue was treated (TABLE I). Deasphalting was effected with pentane, as in example 1, with a yield of 70%. The deasphalted residue was treated as in experiment No. 2 of Example 1, with the same catalysts. Nevertheless the operating conditions had been modified as follows:

Hydrovisbreaking: P=120 bars; T=500° C.; Residence time=5 sec.; $H_2$ feed rate=500 liters/liter.

Hydrostabilization: P=120 bars; T=400° C.; VVH=0.5 $H_2$/hydrocarbons=700 liters/liter.

The results are given in TABLE V.

EXAMPLE 4

Example 1 (experiment No. 2) was repeated, while using a $C_5$–$C_7$ gasoline as deasphalting agent.

The results are similar to those of Example 1 (Experiment No. 2) however the desulfurization rate was slightly lower: the sulfur % was 0.7 for the 375°-520° C. fraction and 1.5% for the 520° C.+ fraction.

EXAMPLE 5

(comparison)

Experiment No. 2 of example 1 was repeated, except that the feed charge was the undeasphalted crude residue whose analysis is given in TABLE I (residue of Arabian oil), instead of the deasphalted residue.

TABLE VI gives the results in column 1. The results of experiment 2 of example 1 are given in column 2 for comparison; for sake of simplicity, the detailed analyses of the 375°-520° C. and 520° C.+ fractions do not appear.

EXAMPLE 6

(comparison)

Experiment No. 2 of Example 1 was repeated, except that propane was used for deasphalting, instead of pentane, the other conditions remaining unchanged. The deasphalting yield was 45%, instead of 85% with pentane.

The composition of the deasphalted vacuum residue is given hereunder:

specific gravity: 0.934 g/cm$^3$
Conradson carbon: 1.7
asphaltenes (insoluble in heptane): 0.05% b.w.
Viscosity at 100° C.: 38 cst.
Ni: 0.5 ppm b.w.
V: 0.5 ppm b.w.
% by weight boiling above 520° C.: 9.

After treatment as in experiment No. 2 of EXAMPLE 1 the deasphalted residue gave the following yields of products:

150° C.−: 7.5%
150°-374° C.: 15.0%
375°-520° C.: 25.0%
520° C.+: 52.5%

These yields are substantially lower than in experiment No. 2 of example 1, which shows the effect of the deasphalting solvent.

TABLE I

CHARACTERISTICS OF THE FEED CHARGES

| | Vacuum residue of light Arabian oil | Boscan atmospheric residue |
|---|---|---|
| Specific gravity (g/cm$^3$) | 1.003 | 1.037 |
| pour point °C. | +20 | +66 |
| VISCOSITY at 100° C. (cst) | 345 | 5,250 |
| S % b.w. | 4.05 | 5.90 |
| N ppm b.w. | 2875 | 7880 |
| Ni ppm b.w. | 19 | 133 |
| V ppm b.w. | 61 | 1264 |
| Conradson Carbon (% b.w.) | 16.4 | 18.0 |
| Asphaltenes % b.w. (insoluble in heptane) | 4.2 | 15.3 |
| Softening point °C. | — | 46.6 |

TABLE II

| EXPERIMENT | 1 | 2 | 3 |
|---|---|---|---|
| Yields b.w. with respect to the deasphalted residue | | | |
| 150° C.− | 9 | 13.5 | 14.5 |
| 150-375° C. | 24.3 | 36.7 | 42.1 |
| 375-520° C. | 200 | 28.6 | 33.9 |
| 520° C.+ | 46.7 | 22.2 | 10.5 |
| 150-375° C. fraction | | | |
| $d_4^{15}$ | 0.850 | 0.852 | 0.854 |
| % S b.w. | 1.70 | 0.05 | 0.03 |
| Diesel number | 46.5 | 47 | 46 |
| Pour point °C. | −21 | −15 | −15 |
| 375-520° C. fraction | | | |
| $d_4^{15}$ | 0.930 | 0.929 | 0.940 |
| S % b.w. | 3.13 | 0.40 | 0.3 |
| Conradson C | 0.30 | 0.06 | 0.06 |
| Metals ppm | 1 | 0.1 | 0.1 |
| 520° C.+ Residue | | | |
| $d_4^{15}$ | 1.06 | 1.017 | 1.020 |

TABLE II-continued

| EXPERIMENT | 1 | 2 | 3 |
|---|---|---|---|
| Viscosity at 100° C. (cst) | 480 | 350 | 450 |
| S % b.w. | 4.28 | 0.80 | 0.60 |
| Conradson C. | 23.8 | 16.0 | 20.0 |
| Asphaltenes precipitable with heptane (% b.w.) | 5.0 | 2.0 | 2.5 |
| Stability (ASTM D 1661-1) | 1 | 1 | 1 |

TABLE III

| | A Atmospheric residue 350° C.+ | B Mixture atmos. distillate + vacuum residue deasphalted with pentane |
|---|---|---|
| $d_4^{15}$ | 0.955 | 0.930 |
| Viscosity at 100° C. (cst) | 27.20 | 13.75 |
| Conradson Carbon % b.w. | 8.00 | 2.65 |
| Asphaltenes % b.w. | 2.00 | 0.05 |
| Sulfur % b.w. | 3.00 | 2.77 |
| Nickel ppm | 11.0 | 3.0 |
| Vanadium ppm | 28.00 | 4.0 |
| Nitrogen ppm | 1975 | 1050 |
| Aniline point °C. | 85 | 87 |

TABLE IV

YIELDS - (% b.w. with respect to the mixture of TABLE III column B)

| | |
|---|---|
| 150° C.− | 14.5 |
| 150-375° C. | 43.5 |
| 375-520° C. | 30.2 |
| 520° C.+ | 12.8 |
| 150-375 | |
| $d_4^{15}$ | 0.852 |
| % S b.w. | 0.05 |
| Diesel number | 47 |
| Pour point °C. | −12 |
| Fraction 375-520° C. | |
| $d_4^{15}$ | 0.913 |
| S % b.w. | 0.3 |
| Conradson C | 0.03 |
| Metals ppm | <1 |
| 520° C.+ | |
| $d_4^{15}$ | 1.02 |
| Viscosity at 100° C. | 350 cst |
| Asphaltenes precipitable with heptane (% b.w.) | 1.5 |
| Conradson C | 15.2 |

TABLE V

YIELDS - (% b.w. of the deasphalted residue)

| | |
|---|---|
| 150° C.− | 12.0 |
| 150-375° C. | 38.0 |
| 375-520° C. | 29.0 |
| 520° C.+ | 22.5 |
| 150-375° C. Fraction | |
| $d_4^{15}$ | 0.855 |
| % S b.w. | 0.1 |
| Diesel number | 45 |
| Pour point °C. | −15 |
| 375-520° C. Fraction | |
| $d_4^{15}$ | 0.935 |
| S % b.w. | 0.5 |
| Conradson C. | 0.1 |
| Metals ppm | 0.1 |
| 520° C.+ fraction | |
| $d_4^{15}$ | 1.03 |
| S % b.w. | 1.0 |
| Conradson C. | 20.0 |
| Asphaltenes precipitable with | |

TABLE V-continued

| YIELDS - (% b.w. of the deasphalted residue) | |
|---|---|
| heptane (% b.w.) | 2.5 |

TABLE VI

| EXPERIMENT | 1 VACUUM RESIDUE | 2 PENTANE-DEASPHALTED VACUUM RESIDUE |
|---|---|---|
| YIELDS | | |
| 150° C.⁻ | 8.5 | 13.5 |
| 150–375° C. | 14.5 | 36.7 |
| 375–520° C. | 22.0 | 28.6 |
| 520° C.⁺ | 55.5 | 22.2 |
| 150–375° C. Fraction | | |
| $d_4^{15}$ | 0.860 | 0.852 |
| % S b.w. | 0.08 | 0.05 |
| Diesel number | 42 | 47 |
| Pour point °C. | −15 | −15 |
| 375° C.⁺ FRACTION - | | |
| Yield | 77.5 | 50.8 |
| $d_4^{15}$ | 0.970 | 0.965 |
| S % b.w. | 0.95 | 0.57 |
| Conradson C. | 10.5 | 7.0 |
| Asphaltenes precipitable with heptane | 4.5 | 0.9 |
| Stability (ASTM D 1661.1) | 2 | 1 |

What is claimed is:

1. A process for converting an asphaltenic oil to lighter fractions, which comprises the steps of:

(a) deasphalting the asphaltenic oil with an aliphatic $C_{5-7}$ hydrocarbon solvent, said deasphalting being effected under conditions such that the major part of the resins remains in the deasphalted oil, and recovering the resultant deasphalted oil;

(b) maintaining the deasphalted oil with hydrogen at 440°–530° C. for 1 second to 10 hours, under a pressure of 40 to 140 bars, in a non-catalytic conversion zone;

(c) feeding the product of step (b) with hydrogen into a catalytic conversion zone at 320°–430° C., under a pressure of 40 to 140 bars, in contact with at least one catalyst comprising at least one molybdenum compound or tungsten compound or a mixture thereof and at least one nickel compound or cobalt compound or a mixture thereof, and recovering the resultant hydrocarbon fractions.

2. A process according to claim 1, wherein the residence time in the non-catalytic conversion zone of step (b) is from 1 to 500 seconds.

3. A process according to claim 1, wherein the effluent of step (c) is fractionated to recover at least one distillate and at least one distillation residue, the distillate is recovered and at least a portion of the residue is fed to step (b) to be treated in admixture with the product of step (a).

4. A process according to claim 3, wherein from 10 to 100% of the recovered residue is fed to step (b).

5. A process according to claim 1, wherein step (c) is performed by passing the product of step (b) through a bed of a first catalyst and then through a bed of a second catalyst, the first catalyst having a ratio R, defined as the atomic ratio $$\frac{\text{Ni plus Co}}{\text{W plus Mo}},$$

of 0.8:1 to 3:1, and the second catalyst having a ratio R of 0.2:1 to 0.5:1.

6. A process according to claim 5, wherein the carrier of the first catalyst has an acidity, determined by ammonia adsorption at 320° C. under an ammonia pressure of 300 mm of mercury, lower than 10 cal/g, and the carrier of the second catalyst an acidity, determined in the same conditions, of at least 30 cal/g, wherein the specific surface of the carrier of the first catalyst is from 40 to 120 $m^2/g$ and that of the carrier of the second catalyst is from 150 to 350 $m^2/g$, and wherein from 0.1 to 1 part by weight of the first catalyst is used per part by weight of the second catalyst.

7. A process according to claim 5, wherein the carrier of the first catalyst is alumina or a cobalt, nickel, magnesium, calcium or barium aluminate or a mixture thereof, and wherein the carrier of the second catalyst is alumina, silica-alumina, alumina-magnesia or silica-magnesia.

8. A process according to claim 1, wherein the whole amount of the product of step (b) is fed to step (c).

9. A process according to claim 1, wherein relatively cool hydrogen gas is added between the steps (b) and (c) to lower the temperature of the effluent of step (b) down to a value of 320° to 430° C.

10. A process according to claim 1, wherein from 0.2 to 10% by weight of water is added to the deasphalted oil before passage in the conversion zones of the steps (b) and (c).

11. A process according to claim 2, wherein the residence time of the reactants in step (b) is from 5 to 60 seconds.

12. A process according to claim 1, wherein the asphaltenic oil is a straight run residue and wherein this residue is subjected to an initial distillation under reduced pressure, the residue of this distillation under reduced pressure is subjected alone to the deasphalting of step (a), the distillate is admixed with the deasphalted residue between the steps (a) and (b) and is then subjected, in admixture with the latter, to steps (b) and (c).

13. A process according to claim 3, wherein a portion of the distillate recovered in the fractionation of step (c) is fed to step (b), in addition to the residue from the same fractionation.

14. A process according to claim 1, wherein said aliphatic $C_{5-7}$ hydrocarbon solvent is at least one of n-pentane, isopentane, a saturated $C_7$ cut, a saturated $C_{5-7}$ cut, a $C_5$ olefinic cut or a $C_6$ olefinic cut.

15. A process according to claim 14, wherein said solvent is n-pentane.

16. A process according to claim 1, wherein the yield of deasphalted oil recovered from step (a) is at least 70% by weight.

* * * * *